US005288174A

United States Patent [19]

Kjersem et al.

[11] Patent Number: 5,288,174

[45] Date of Patent: Feb. 22, 1994

[54] JACKABLE OIL RIGS AND CORNER COLUMNS FOR PRODUCING LEGS IN AN OIL RIG

[75] Inventors: Geir L. Kjersem, Bones; Sture Rundhovde, Valestrandsfossen, both of Norway; Gunnar Foss, The Hague, Netherlands

[73] Assignee: Offshore Innovation Limited A/S, Alesund, Norway

[21] Appl. No.: 793,401

[22] PCT Filed: Jul. 11, 1990

[86] PCT No.: PCT/NO90/00114

§ 371 Date: Jan. 14, 1992

§ 102(e) Date: Jan. 14, 1992

[87] PCT Pub. No.: WO91/01411

PCT Pub. Date: Feb. 7, 1991

[30] Foreign Application Priority Data

Jul. 14, 1989 [NO] Norway ..... 892896

[51] Int. Cl.[5] ..... E02B 17/00

[52] U.S. Cl. ..... 405/196; 405/203; 405/227; 52/725; 52/726.3

[58] Field of Search ..... 405/227, 196, 197, 203, 405/204, 198, 199, 195.1; 52/725, 726.1, 726.3, 726.4, 732.3, 727, 309.1, 637, 638

[56] References Cited

U.S. PATENT DOCUMENTS

| | | | |
|---|---|---|---|
| 163,993 | 6/1875 | Hardy | 52/732.3 X |
| 3,199,300 | 8/1965 | Fiore | 52/725 X |
| 3,213,629 | 10/1965 | Manning | 405/227 X |
| 3,564,856 | 2/1971 | Blount . | |
| 3,601,999 | 8/1971 | Olsen . | |
| 3,967,458 | 7/1976 | Scales . | |
| 3,986,368 | 10/1976 | Levingston . | |
| 3,987,636 | 10/1976 | Hruska . | |
| 4,040,265 | 8/1977 | Hellerman . | |
| 4,069,683 | 1/1978 | Jansz | 405/227 |
| 4,080,795 | 3/1978 | Weidler | 405/227 |
| 4,087,978 | 5/1978 | Landers | 405/227 |
| 4,265,568 | 5/1981 | Herrmann et al. | 405/196 |
| 4,493,592 | 1/1985 | Knox | 405/227 X |
| 4,695,202 | 9/1987 | Ferrari Aggradi et al. | 405/227 |

FOREIGN PATENT DOCUMENTS

| | | | |
|---|---|---|---|
| 0096650 | 12/1983 | European Pat. Off. . | |
| 0204041 | 12/1986 | European Pat. Off. . | |
| 0642656 | 9/1928 | France | 52/726.3 |
| 0635210 | 11/1978 | U.S.S.R. | 52/726.3 |

*Primary Examiner*—Dennis L. Taylor
*Attorney, Agent, or Firm*—Francis C. Hand

[57] ABSTRACT

The jackable oil rig employs a leg formed of a plurality of corner columns and transverse stays. Each column is formed of an outer pipe, and inner pipe which defines an annular space with the outer pipe and a hardenable material such as concrete in the space between the pipes. The outer pipe has a constant outer diameter along the length while the inner pipe has a constant outer diameter along the length and an increasing wall thickness from a top section to a bottom section. The wall thickness of the inner pipe may increase step by step from about 30 millimeters in the upper section to about 150 millimeters in the lower section. The construction of the corner column allows oil rigs to operate at ocean depths down to 200 meters.

14 Claims, 3 Drawing Sheets

JACKABLE OIL RIGS AND CORNER COLUMNS FOR PRODUCING LEGS IN AN OIL RIG

The present invention relates to a jackable oil rig designed for operations at large ocean depths, and comprising at least one leg and a deck with a jack system, the leg (or the legs) comprising a number of corner columns together with transverse stays, and where each corner column comprises a substantially annular outer pipe in which a substantially annular inner pipe is arranged, and the annular space between the inner wall of the outer pipe and the outer wall of the inner pipe is filled with a hardenable material such as concrete, capable of transferring forces between the pipes, the outer diameter of the outer pipe being approximately constant over the whole length of the column. The oil rig according to the present invention is especially suitable for operations at ocean depths down to 200 meters.

The present invention also relates to a corner column. The invention thus has particular application to jackable platforms which are employed especially as service platforms for more localized rigs, but can also be used for boring and the production of oil and gas.

For the extraction of oil and gas at sea it is usual to employ jackable platforms. Such platforms usually have three or more independent legs which can stand at varying depths of water. At shallower ocean depths such as in the Gulf of Mexico it is usual that the platforms stand at from 20 to 60 meters, and the platform legs are often anchored on the bottom by means of steel and concrete bases, (mat support rig). With such bases the jackable platforms are braced and have better fatigue properties.

In the region of the North Sea, jackable platforms have been used for depths of up to 80–90 meters. In this region, however, the environment is much harsher and the platform constructions are therefore stronger than in the Gulf of Mexico.

The jackable platforms can be moved from place to place within the operational water depths in so far as such occur with floating platforms and drilling ships. The jackable platforms stand however fastened to the bottom and are therefore much less exposed to movements, something which is especially important for the connection of the boring and production pipes between the bottom of the ocean and the deck of the platform. Consequently, it is simpler to carry out the necessary operations in the well such as different measurements, logging, washing and other maintenance from a jackable rig. When the boring and production pipes are coupled up, there is less danger of disruptions by virtue of bad weather than for floating platforms.

Besides, jackable platforms are cheaper to produce than floating platforms since the shape of the hull is simple and since there are employed as a rule well developed, well tested and reasonable jack systems, and in addition it is not necessary to mount anchoring systems. Thereby the running of the platform also becomes more reasonable.

Most jackable platforms have the drilling rig placed on a projection on the deck. This allows the platform to move the drilling rig in over another permanent platform so that the drill stem can be guided through its structure. Consequently, the permanent platform does not need to have its own boring equipment since it will then pay to hire in the drill work from a special platform in preference to supplying the permanent platform with equipment which has a much shorter service life. However, heavy demands are placed on the relative movements between a permanent platform and the jackable platform because these are generally connected with rigid drill pipes, production pipes and others. Such problems increase with increasing depths of water since the jackable platforms have larger deflections than the specially constructed permanent platforms.

Several jackable platforms have moreover been reconstructed in order to be able to produce oil and gas directly, and since the type of platform is mobile, such reconstructions can be easily carried out on land and also the rig can be moved without any problems to a new field after the oil field is empty.

The main problem with this type of platform, which usually has three legs, is that it cannot be employed at water depths greater than 80–100 meters, and there is consequently a desire within the trade to expand the field of operation to greater ocean depths. However, hitherto constructions have not been produced other than the previously known jackable platforms having traditional leg constructions with parallel corner columns and horizontal and obliquely positioned bracing stays.

In drilling regions as in the North Sea where the ocean depth is as a rule over 100 meters such platforms are exposed to very strong fatigue forces both in the deck and in the legs. Under difficult environmental conditions, jackable platforms are very sensitive to large weights on deck, something which increases the fatigue problem as a consequence of the horizontal deflections and swinging cycles increasing strongly. Such deflections create problems for drill stems, production pipes and the like when the jackable platform is placed close up to a stationary platform as is explained before. Moreover, the problem increases with increasing depths of water and the platform can consequently not take on board all the heavy equipment which is required.

Such problems have long been known, and in the oil industry solutions have been launched at regular intervals such as bracing the while construction in order to reduce the natural swinging cycles which heavily influence the fatigue of the structure. This can be done by redimensioning the construction so that the strength increases. However, this leads to greater expenses and also steel qualities must be used which are complicated to finish and weld if the thickness of the material has to be increased. Besides this provides only a limited benefit since the region of use (the ocean depth) can only be increased by about 10–20 meters. Furthermore, it is proposed (as will be discussed later the description) to secure the legs to the ocean bottom such as by means of piling, make the lower leg portions thicker and/or anchor the legs in steel and concrete mats in order to make the platforms more rigid and less fatigue stressed. However, it is complicated to position the pile foundations and also it is difficult to remove the platform when it is first thoroughly secured to the ocean floor.

Furthermore, it has been proposed to utilize submerged concrete boxes as artificial sea bottoms, but such foundation constructions are difficult to handle and position at the same time as they are expensive and require long construction times. Furthermore, they are very complicated to remove when they are first installed. This solution can however be appropriate for fields where the concrete box can be utilized for operating a large number of wells, and when the early production of oil is of no interest so that the concrete box can remain standing on the sea bottom after the jackable platform has left the field.

For jackable oil rigs, solutions have also been launched where instead of three or four legs only one leg is used. This is for example disclosed in U.S. Pat. No. 4,265,868 and in Patent Specifications Nos. 830,569, 860,304 and 843,747. Common to the three first-mentioned publications is that they comprise a foundation of concrete or steel, a tower framework of steel and a deck which can be jacked up or down so that it can be positioned at a satisfactory distance from the ocean floor, the platform either standing alone or it bores over another permanent installation. Thereby greater rigidity is obtained at the same time as the fatigue problems are reduced. The jack system which cooperates with the vertical corner columns of the legs requires however that the columns have a substantially uniform thickness over the whole length of the leg since the jack system can pensate with difficulty for changes in the diameter of the columns.

Single tower platforms are a further development of so-called base-foundationed ("mat supported") jackable rigs of which many are found on a world basis. These have three or more legs and operate in calm waters of 15–60 meters depth, such as in the Gulf of Mexico. In exposed waters such as the North Sea they cannot operate by virtue of large environmental forces. The declared advantage with single tower solutions is that these can operate in deeper waters than the conventional base-foundationed rigs. Such platforms are however not constructed.

The reason for the lack of success with such constructions is that in deep water and in exposed regions, the tower construction must be reinforced, something which is also shown by calculations. Such calculations thus show that this type of platform can operate at a maximum of 90–110 meters depth in calm waters and at best in 70–90 meters in North Sea-like waters. This benefit is large relative to the base-foundationed platforms, but nevertheless cannot compete with conventional jackable platforms having three legs such as shown in U.S. Pat. No. 3,986,368. This type is constructed to-day for North Sea conditions with a maximum depth of water of 100 meters with a deck cargo of 15,000 tons.

The single tower platform proposed in U.S. Pat. No. 4,265,568 must be designed with compromises which make it unsuitable for large depths of water in exposed regions. These compromises affect on the one hand strength and the capsize moment against heavy waves, currents and wind and on the other hand fatigue and the quality of the steel. In order that the jack system shall function, the corner columns of such platforms have like diameters from top to bottom, and this reduces the possibility for compromises.

In the known platforms, great strength can be achieved by designing columns and stays with large diameters and wall thickness. Viewed theoretically, this is possible since the lowest portion of the corner columns will be determined for strength both as regards column diameter and wall thickness. At water depths of 150 meters such a construction will have a need for pipes having a wall thickness of the order of magnitude of 250 mm if the diameter of the corner columns shall be 1800 mm and the construction shall have satisfactory rigidity/strength and capsize moment.

Consequently there have not been produced any satisfactory construction for jackable rigs having leg lengths close to 250 meters, so that these can be employed for much greater ocean depths, that is to say down to about 200 meters, than those which are usual today for such leg constructions.

Concrete is a well-known material in offshore constructions and has the property that it tolerates large pressure stresses. EP Patent Application No. 0,096,650 deals for example with the use of concrete in the form of a cap which is built into a steel sleeve in order to be able to absorb fully hydrostatic pressure and provide a ballasting effect. Typical wall thickness for reinforced concrete as for example a water depth of 150 meters is 60 to 70 cm minimum in a submerged cylinder having a diameter of 15 m. Such constructions however cannot remedy the problems which one aims to solve with the present invention.

In order to obtain an extra base foundation it has been usual for permanent steel platforms, such as disclosed for example in U.S. Pat. Nos. 3,601,999, 3,564,856 and 4,273,474, to employ a special stake method to the effect that there is introduced concentrically through corner columns of the construction, which can be vertical and parallel or oblique, a pile in the form of a pipe which by means of a suitable pile hammer is driven into the ocean bed and where finally concrete is introduced into the space between the pipes so that the pile is secured properly to the corner column. After the concrete has set, the steel structure can withstand heavy stresses as a result of environmental forces from waves, currents and wind. The purpose of the piling is that the platform is able to be securely anchored to the ocean bed and also braced to some degree. According to the last-mentioned U.S. patent a construction is produced which aims to solve the problem of uneven distribution of forces from the piles and into the steel construction. This is solved in that the piles are not cast into the guide pipe over the whole of their lengths. The pile placements referred to are to take place according to said patents however after the rig is positioned on the ocean floor, and therefore concentrate attention on reliable methods of filling the intermediate space between column and pile with concrete mixtures. Since this involves stationary platforms which shall stand permanently fixed to the bottom at lower ocean depths, the problem positions which this piling shall solve, are totally different than for jackable oil rigs. The pile elements, for example as they are described in U.S. Pat. No. 4,273,474, shall moreover not have any special load-supporting properties.

On these permanently positioned steel rigs, it is known (see for example U.S. Pat. No. 4,273,474) besides to mount extra vertical and oblique guide pipes, and pile pipes or columns are driven down through the guide pipes into the ocean floor and these ar bound to the guide pipes by means of concrete in the same way as mentioned above. According to this patent, the aim is to solve the problem of uneven distribution of forces from the piles and into the remaining part of the steel construction. This is solved by not casting the piles into the guide pipe over the whole of their length.

These patent publications relate to stationary types of platform fixed to the bottom where it is not necessary to have regard for jack systems during the construction and the design of the leg framework.

In the wave zones of the platforms it is known furthermore to install a shorter pipe within corner columns in order to increase the strength of the stationary platform on possible impact with vessels.

It is an object of the present invention to produce a jackable platform construction which has sufficient strength and good enough use and handling characteristics to be able to be utilized at greater ocean depths than those which are usual to-day, that is to say that it can thus be used at ocean depths down to 200 meters.

It is also an object of the present invention to produce a new construction for a corner column.

Briefly, the invention is directed to a jackable oil rig comprising a deck, at least one leg for supporting the deck and a jack system on the deck for moving the deck relative to the leg. In addition, the leg is formed of a plurality of corner columns and a plurality of transverse stays which interconnect the columns.

In accordance with the invention, each column has an outer pipe with a constant outer diameter along the length inner pipe defining an annular space with the outer hardenable material in a space in between the pipes.

The jackable oil rig according to the present invention is characterized in that the outer diameter of the inner pipe is approximately constant while its wall thickness $t_i$ increases from the upper section of the corner column to the lowermost section of the corner column.

According to an especially preferred construction of the present oil rig the wall thickness $st_i$ of the inner pipe increases gradually from upper section (I) of the corner column to lower section (VI) of the corner column. According to a further preferred construction the wall thickness of the outer pipe is approximately constant over the whole length of the column.

By the combination of the afore-mentioned features, there is produced a jackable oil rig which has sufficient strength so that it can be operated at large ocean depths. The application of the double pipe construction known per se in combination with the specific pipe diameter relationships and wall thicknesses, means that a rig with for example one leg has very acceptable and lower swinging cycles as a consequence of the influences of wind and waves, than corresponding oil rigs without the said features. That the inner pipe has a gradually increasing wall thickness at the same time that its outer diameter is maintained constant, means that the bottom portion of the rig can tolerate the increased weight load resulting from the large column and leg lengths.

The corner column according to the present invention is characterized in that the outer diameter of the inner pipe is approximately constant while its wall thickness $t_i$ increases from the upper section (I) of the corner column to the lowermost section (VI).

The maximum plate thickness which is delivered commercially to-day, and which is employed for the lowermost section of the inner pipe in the solution according to the invention (see the table), is about 150 mm since this represents in supporting constructions the outer limit for what is advisable to weld with satisfactory later control of the welds.

Even if it should be possible in the future to roll and weld steel pipes with a wall thickness of 250 mm, the oblique stays in against the corner columns must nevertheless be welded directly to this thick-walled pipe which forms the corner column, something which will give a hugely complicated construction from the technical welding aspect and provide a fatigue relationship at the junctions which can be controlled with difficulty. The fatigue occurs over time as cracks in the construction and inspection/repair of steel with junctions which involve these wall thicknesses is almost impossible to achieve according to specification, not least when this portion of the platform finds itself under water and the fatigue lifespan for such constructions will thereby be very low.

An important advantage with the solution according to the present invention is that with the combination with double pipes which are cast together with concrete, one can employ conventional fabrication techniques during the construction. The inner pipe which has a wall thickness close to the fabrication maximum, has only longitudinal weld seams when they are produced as pipe elements. On welding these elements together, simple girth welds are used. The inner pipe is not a part of the junctions since only the outer pipe of the corner column is welded in against the oblique stays. This pipe has, according to the present solution, a wall thickness of 63 mm something which can be conventionally fabricated. The wall thickness of the outer pipe makes it repairable by known techniques if fatigue cracks should appear. Fatigue cracks which necessarily arise will moreover not spread inwards to the inner pipe because this is separated by an annular space filled with concrete or another hardenable material.

In the platform which is described in U.S. Pat. No. 4,265,568 these problems are avoided by utilizing large wall thicknesses and diameters. With a diameter of the corner column of 3.5 m one will be able to employ for example wall thicknesses of 150 mm if everything else is constant. Thus the top of the corner columns would have a diameter of 1.3 m if this applied to a conventional, piled steel platform. This compromise involves however a high capsize moment for a jackable platform with a corner column diameter of 3.5 m in deep water and with high waves, since the jack system requires corner columns of like diameter. This will make the platform applicable for calm waters having average water depth, but unsuitable in exposed regions with higher waves.

For the single tower platform according to the present invention, steel can be employed having conventional solidity and high rigidity, and this gives it natural cycles of about 4 seconds. This wave response cycle gives the platform very good fatigue characteristics because the wave energy in this region is low. The inner pipe in the concrete in the intermediate space in addition bolsters the junctions and makes these more resistant to fatigue.

For the conventional solutions, a solution would be to make a slender steel tower with very high compact steel. This steel is however little used on offshore installations by virtue of welding and inspection problems. Even if this should allow itself to be solved, such a construction would nevertheless be fatigue stressed because it will be very soft. It will have high natural cycles and with this lands in the portion of the wave spectrum which has much energy, for example in the North Sea over 6 seconds.

Another big advantage with the afore-mentioned design of the stratified corner column construction lies in the production side. Such double pipe constructions according to the present invention can thus be manufactured in that the inner pipe is prefabricated over the whole of its length before it is introduced in the ready made outer pipe which comprises internal spacers so that the inner pipe is oriented concentrically. After this, concrete or mortar can be pumped into the pipe intermediate space. One obtains thereby big advantages in that the work can be effected at the workshop, that identical components can be used and one obtains a big repetition benefit. Due to the step by step increase of the wall thickness of the inner pipe only occurring in towards its longitudinal axis, the production equipment can be used for producing each and all of the corner column sections without there being need for any time-consuming or expensive adjustments of the equipment. It becomes only a question of effecting a suitable choice of inner pipe with correct dimensions.

Over the whole length of the corner column there can be used furthermore oblique stays and horizontal stays which are mass produced with similar or approximately similar dimensions such as pipe lengths and diameters, and purely as regards production one achieves a great simplification when columns and stays are to be mounted together for a framework.

The utilization of a corner column with this design having double pipes with concrete or mortar in the annular space between the pipes provides furthermore a drastic increase in the static strength of the junctions between columns and stays compared to corner columns with only a single wall. Furthermore the stress concentrations at the junctions are reduced.

The wave loading on a platform is nearly proportional to the sum of the pipes which cut the surface of the water. Viewed relatively since there can be used in the present invention pipes with much smaller and constant diameters, that is to say down to 1.8 meters, this leads to reduced leg weight and consequently reduced loading both on the leg construction and in the concrete foundation. (With known oil rigs, it has been usual for the diameter of the corner column to increase gradually from about 1.3 meters uppermost and up to 3.5 meters lowermost). The fatigue loadings on the column construction from larger waves is also reduced as a consequence of the lower column diameter. To a still greater degree, this relationship will apply to lesser waves which provide the greatest contribution to the fatigue. The loadings are inertia-dominated and thereby nearly proportional to the sum of the squares of the pipe diameters of the pipes which cut the surface of the water.

Moreover in order to be able to employ an uncomplicated jack system the condition is, that corner columns of the leg are arranged mutually parallel along the whole length of the leg and each column has a constant diameter. The rig leg according to the present invention meets these requirements. In a preferred embodiment of the double column construction where a pin in hole (pin in hole) jack system is used and where abutment holes of the jack pins in each column are formed directly in the corner column, the abutment of the jack system against the corner column is designed so that the jack pins only form abutments against the outer pipe of the column and preferably form no contact with the concrete in the annular space or the inner pipe. If local crumbling of the concrete occurs around each jack pin, this plays little or no role since the transfer of force takes place in any case via the outer pipe and through the concrete and to the inner pipe and the remainder of the concrete. It has been found that the stratified construction involves a greatly reduced loading from the jack pins on the metal material of the outer pipe as a result of the local rigidity at the fastening points of the jacks on the columns increasing. It has thus been found that the concrete can be effectively absorb and distribute point loadings from the jack pins on the outer pipe and in to the inner pipe as well a further out into the remainder of the framework, The danger of local deformations in the pipes is thereby reduced. The leg length for this type of platform can consequently be extended at the same time as the column diameter continues to be maintained relatively low (about 1.8 meters).

In the present solution, the corner columns can be produced with smaller wall thicknesses than hitherto and this provides a more favorable fatigue curve which depends on wall thickness, it (the fatigue) becoming greater with increasing thickness. By employing double pipes there is achieved a marked increase in the wall rigidity something which reduces the danger of crack fractures as a result of external water pressure.

When a ship pushes against a rig leg, the local strength of the pipe wall is decisive in the occurrence of dents add similar damage. Local dents lessen the fracture mechanism of the plastic three hinge and reduce the possibility for greater deformations of the corner columns since one obtains significantly higher strength in the stratified pipe constructions according to the invention.

As a consequence of the increasing static strength in the junctions it will be possible as a rule to design the platform so that the junction connection becomes stronger than the branch pipes, something which will have decisive significance for the ductility of the platform. Also, in evaluations of for example the residual strength in connection with damage, the increasing static strength of the junctions often has decisive significance. By virtue of the increased rigidity of the wall which is achieved with double pipes, there is no longer such a strong need for annular braces for avoiding squeezing flat or ovalising the corner column at the junctions. Furthermore one has now reduced or totally eliminated the need for annular braces or longitudinal braces on the corner columns in order to avoid the origination of defects as a result of external water pressure.

Further features and advantages of the present invention will be evident from the following description and claims having regard to the accompanying drawings, wherein:

Figure 1:
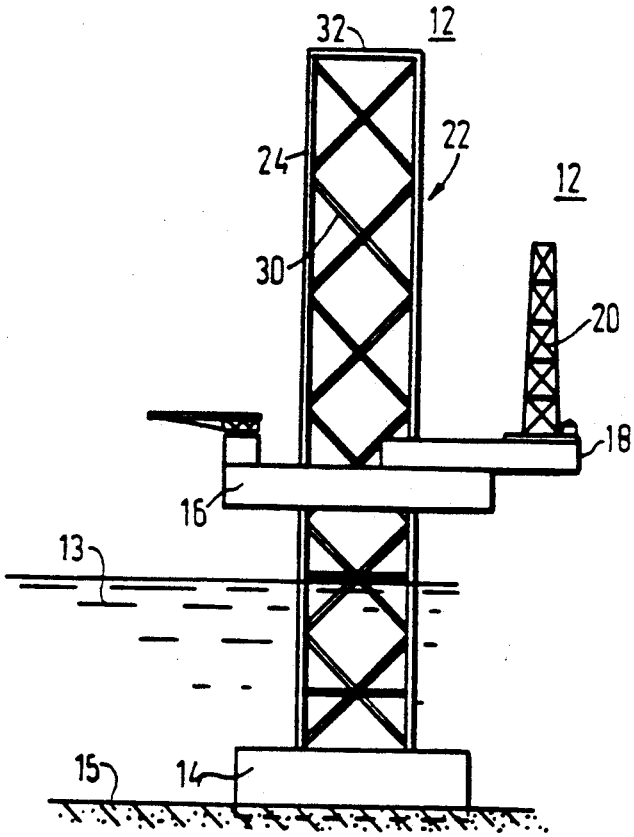
FIG. 1 shows a side section of a jackable oil rig having one leg.

In FIG. 1 there is shown a side section of a jackable oil rig 12 designed with a leg construction comprising corner columns 24 according to the present invention. The rig 12 comprises a deck 16, a leg 22 which is anchored such as by casting in a base foot 14 which further forms the foundation of the rig 12 against the ocean floor, and a jack system (not shown in detail in the Figure) which, when the deck construction floats, can raise or lower the rig leg 22 including the foot 14 relative to the ocean floor 15, When the leg 22 stands on the ocean floor 15 the deck 16 can be raised upwards and downwards relative to the surface 13 of the ocean, and it is in such a position the rig is shown in FIG. 1. Since the deck 16 can float on the ocean surface 13, the whole of the rig construction can be moved from place to place.

From FIG. 1 it is evident that the rig comprises a tower 20 placed on a projection 18 of the deck, and this can for example be a drilling rig. The rig according to FIG. 1 is shown with only one leg 22, but it is obvious that it can equally well be constructed with two or more legs. It is most preferred that the rig comprises 3 or 4 independent legs which are all equipped with their respective jack arrangement.

Figure 3:
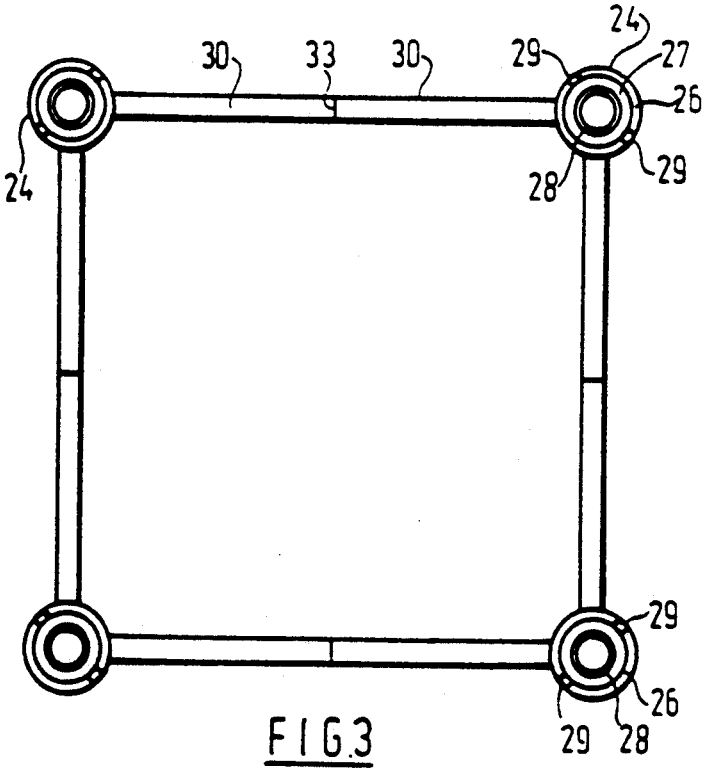
FIG. 3 shows a plan view of the platform, and indicates fastening points of the jack system to the leg.
Figure 2:
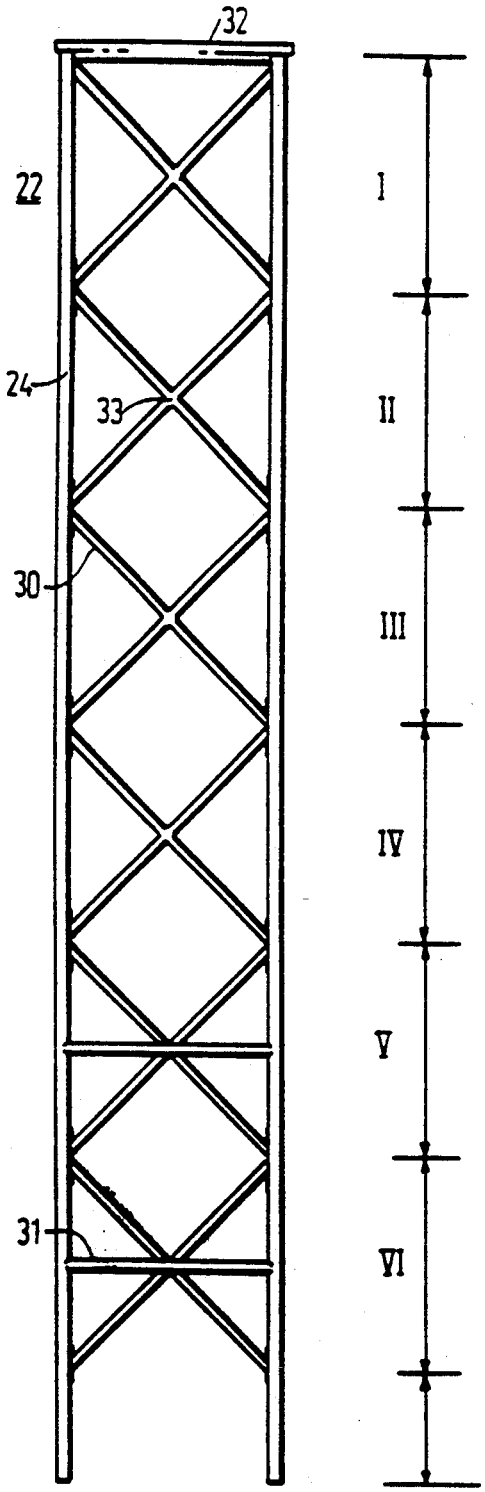
FIG. 2 shows a side section of the leg construction itself for such a platform the platform being divided into several sections.

FIG. 2 shows an enlarged section of the rig leg 22 itself, The leg 22 is constructed of a number of corner columns 24, in this case four columns (see also FIG. 3) which are bound together by means of bracing stays in the form of oblique stay 20 and to a tower framework. In the lower portion of the leg 22 (see also FIG. 1) there are also installed horizontal bracing stays 31, while uppermost i the leg there is assembled a frame 32. In FIG. 2 the rig leg is besides divided into six sections I-VI. Each section constitutes for example a leg length of 40 meters so that the rig leg construction has a length of about 240 meters. As to pure production it is an advantage that the section length, for square leg constructions such as shown in FIG. 3, is the same as the distance between the columns since the oblique stays can thereby be mounted at an angle of 45°. The object of this dividing, which is only included in order to illustrate the principle of the invention, will be discussed further later in the description.

FIG. 3 shows a plan view of the leg 22 and shows the four corner columns 24 which are mutually bound together by bracing stays 30 and the crossing or junction points of the oblique stays are shown at 33. The stays are necessarily for bracing the construction. In order to alter the positioning of the deck 16 relative to the leg 22 there is utilized as mentioned a jack system. There are to be found a series of such well-known jack systems of which the most usual are a toothed bar system, toothed wheel systems, and a pin-in-hole system. In the last-mentioned jack system, the jacks in the deck construction can via jack pins form their respective abutments against bores 28 which are designed longitudinally in outer walls of the corner column 24. Alternatively, the engagement holes can be formed directly in rails which are permanently welded longitudinally in the pipe outer wall.

Figure 4:
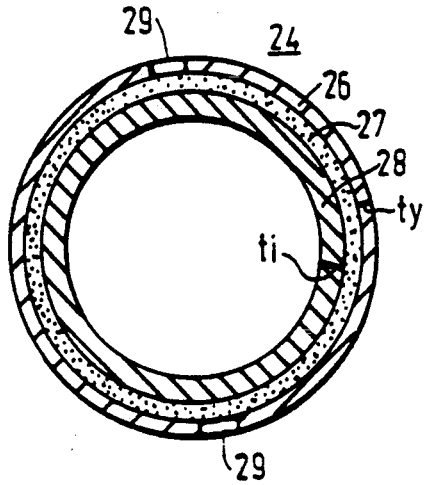
FIG. 4 shows a cross-section of a corner column having a stratified pipe construction according to the invention, along the line IV—IV of FIG. 5.
Figure 5:
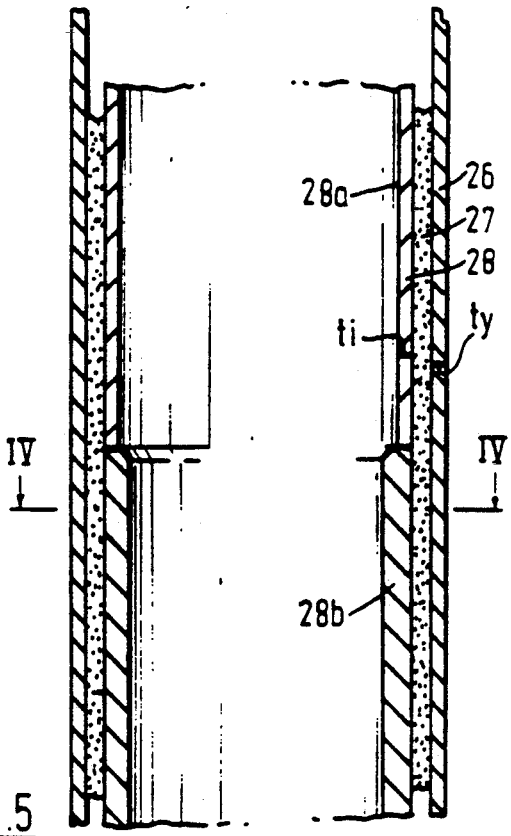
FIG. 5 shows a side section of the corner column, the jack system being omitted.

FIG. 4 shows a cross-section of a corner column 24 according to the invention along the line IV—IV of FIG. 5. The corner column 24 comprises an outer pipe 26 which essentially has a circular cross-section. The outer pipe 26 has with respect to the jack system a substantially constant diameter over the whole length of the column. In the outer pipe there are formed besides bores 29 for the jack pins. The material of the outer pipe comprises moreover a usually easily weldable steel quality, and furthermore the outer pipe 26 (which constitutes the outer side of the corner column 24) preferably has a diameter of about 1.8 meters and a constant wall thickness $t_y$ of about 6.0 cm over the whole length of the leg 22. Within the outer pipe 26, there is concentrically arranged an inner pipe 28, for example of the same easily weldable steel quality as the outer pipe, and preferably concentric to the outer pipe 26. The outer diameter of the inner pipe 28 is constant over the whole length of the column, and is less than the inner diameter of the outer pipe 26 so that there is formed between the pipes a hollow space in the form of an annular space 27. The annular space 27 has suitably a breadth of about 5.0 cm and is essentially constant over the whole length of the leg 22 (that is to say of the column 24). The annular space is further filled in with a hardenable material such as concrete or mortar so that the column constitutes an annular, stratified and reinforced construction.

FIG. 5 shows a longitudinal section of the corner column according to FIG. 4 and illustrates the transition from a section of the leg to a subsequent section such as indicated in connection with FIG. 2. The inner pipe 28 has a gradually increasing wall thickness $t_i$ the lower section of the inner pipe **28*b* (see the FIG.) having a greater wall thickness than the upper section 28*a*** of the inner pipe. For example, the wall thickness of the inner pipe can increase step by step from section to section downwardly along the leg so that the wall thickness increases from about 3 cm in the uppermost section I to about 15.0 cm in the lowermost section VI. Preferably the thickness increases step by step as is evident from the following Table I.

TABLE

| | Section | | | | | |
|---|---|---|---|---|---|---|
| | I | II | III | IV | V | VI |
| $t_y$ | 63 | 63 | 63 | 63 | 63 | 63 |
| $t_i$ | 32 | 47 | 77 | 97 | 97 | 150 |

where $t_y$ indicates that the thickness of material of the outer pipe in mm, $t_i$ indicates the thickness of material of the inner pipe in mm while the section number is indicated along the leg of FIG. 2. The gradual increase of the thickness of the inner pipe can also be carried out in another way than step by step. Thus the thickness can be increased uniformly and continuously over the whole length of the pipe.

For such large lengths as are discussed here, namely up to 250 meters, it is preferred with the increase in the thickness of material of the inner pipe illustrated in the Table for the construction to be able to support the increasing static vertical loading.

Figure 6:
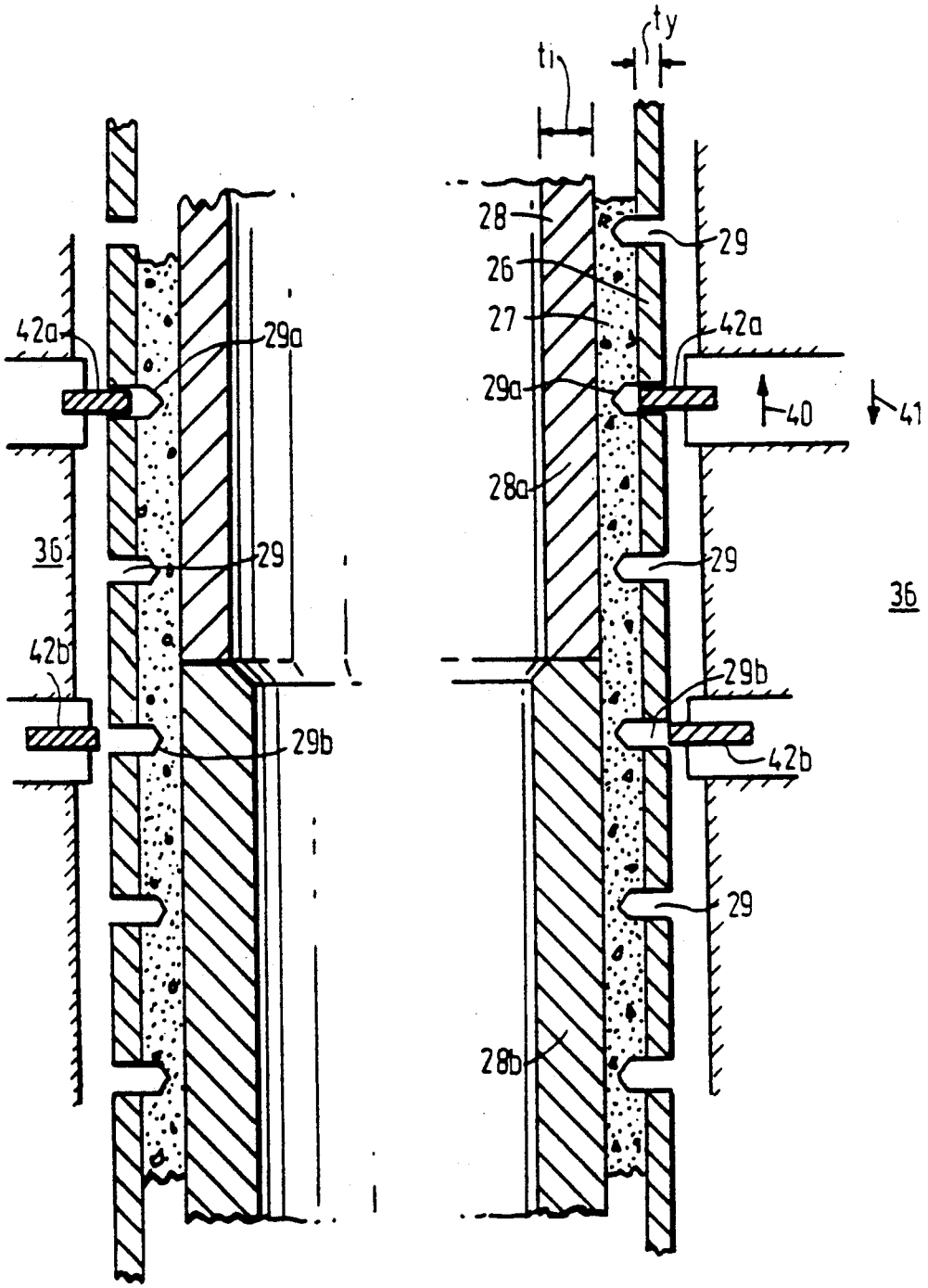
FIG. 6 shows a side section of the corner column in the same way as FIG. 5, there being shown how a jack system can cooperate with the column construction.

In FIG. 6 there is simply sketched how a jack system 36 in the form of a pin-in-hole jack system can be adapted to corner columns 24 of the rig 12, the jack system in connection with each column surrounding and forming abutments against substantially diametrically opposite column sides. In the corner column 24, a series of holes 29 are bored in the outer pipe 26 which jack pins 42 of the jack system 36 can fit into and form abutments against the outer pipe, the holes being bored at mutually regular distances parallel to the longitudinal axis of the pipe. Even if the jack pins (in operation) come to contact the layer of concrete and crumble and crush this locally, this happens only point by point and has no negative consequence on the force-distributing function of the pipe construction. In all cases, the jack pin will weight load the outer pipe so that this forms the basis for the distribution of force via the concrete and the inner pipe and to the remainder of the framework. In FIG. 6 there is shown as an example that the jack pins **42*a* form abutments against the outer pipe inside holes 29, while pin 42*b* present below is withdrawn relative to the hole 29*b***.

By means of a jack aggregate, which is mounted on the deck 16 and which is not shown in the Figures, the mutual placing of the deck 16 relative to the leg 22 can be changed in a known manner. When the jack system is operated so that the pins are moved upwards in the direction of the arrow 40, the leg 22 is raised upwards when the deck 16 floats, while the deck instead moves downwards towards the ocean surface if the leg 22 stands on the ocean floor 15 (FIG. 1). When the jack pins are operated downwards in the direction of the arrow 41, the leg 22 is lowered when the deck floats, while the deck 16 is raised when the leg 22 stands on the ocean floor 15.

It has been found that the utilization of stratified corner column constructions contributes to a surprisingly strong and favorable distribution of the point loading forces from abutments of the jack pins against the outer pipe of the column, and one avoids deformations of the metal material in the region around jack holes of the column. Since at the starting point the jack only loads the outer pipe one should expect in addition that strong cutting forces (mutually parallel displacements) would arise in the pipe construction and consequently tendencies for displacement deformations between the members of the stratified construction. Such deformation effects are however not established during the tests which are undertaken, and this demonstrates how effectively the stratified construction has the ability to distribute and equalize the forces from the jack system.

A jackable rig where the corner columns are constructed in this manner has accordingly been found to have very good and surprising characteristics, as is explained above, and the field of use for the jackable rigs can consequently be heavily expanded, since it can now be used at much greater depths, that is to say down to 200 meters, than the known jackable oil rigs.

We claim:

1. A jackable oil rig comprising a deck;

a base foot;

at least one leg for supporting said deck on said base foot, said leg having a plurality of corner columns and a plurality of transverse stays interconnecting said columns, each said column having an outer pipe with a constant outer diameter along the length thereof, an inner pipe defining an annular space with said outer pipe and having a constant outer diameter along the length thereof and an increasing wall thickness from a top section thereof to a bottom section thereof, and a hardenable material in said space between said pipes to form a prefabricated stratified construction with said pipes; and a jack system on said deck for moving said deck relative to said leg.

2. An oil rig as set forth in claim 1 wherein said outer pipe has a constant wall thickness along the length thereof.

3. An oil rig as set forth in claim 1 wherein said wall thickness of said inner pipe increases in stepwise manner from said top section to said bottom section.

4. A prefabricated column for an oil rig leg of a jackable oil rig comprising an outer pipe with a constant outer diameter along the length thereof;

an inner pipe fixedly cast with said outer pipe to define an annular space with said outer pipe and having a constant outer diameter along the length thereof and an increasing wall thickness from a top section thereof to a bottom section thereof to support an increasing static vertical loading; and a hardenable material in said space between said pipes and securing said pipes together to form a prefabricated stratified structure.

5. A column as set forth in claim 4 wherein said outer pipe has a constant wall thickness along the length thereof.

6. A column as set forth in claim 4 wherein said wall thickness of said inner pipe increases in stepwise manner from said top section to said bottom section.

7. A column as set forth in claim 4 wherein said inner pipe has a maximum wall thickness of 15 centimeters

8. A column as set forth in claim 4 wherein said inner pipe has a wall thickness which increases in stepwise manner from section-to-section and in a sequence of 32, 47, 77, 97, 97, 150 millimeters.

9. A column as set forth in claim 8 wherein said outer pipe has a wall thickness which is constant at 63 millimeters over the length of said sections of said inner pipe.

10. A column as set forth in claim 9 wherein said outer pipe has a length of 25 meters.

11. A column as set forth in claim 4 wherein said material is concrete.

12. A jackable oil rig comprising a deck;

a base foot for placement on an ocean floor;

at least one leg for supporting said deck on said base foot, said leg having a plurality of prefabricated corner columns and a plurality of transverse stays interconnecting said columns, each said prefabricated column having an outer pipe with a constant outer diameter along the length thereof, an inner pipe defining an annular space with said outer pipe and having a constant outer diameter along the length thereof and an increasing wall thickness from a top section thereof to a bottom section thereof to support an increasing static vertical loading, and a hardenable material in said space between said pipes; and a jack system on said deck for moving said deck relative to said leg.

13. An oil rig as set forth in claim 12 wherein said outer pipe has a constant wall thickness along the length thereof and is of a length to support said deck in water of at least 200 meters depth.

14. An oil rig as set forth in claim 12 wherein said wall thickness of said inner pipe increase in stepwise manner in six steps from said top section to said bottom section.

* * * * *

UNITED STATES PATENT AND TRADEMARK OFFICE

CERTIFICATE OF CORRECTION

PATENT NO. : 5,288,174

DATED : February 22, 1994

INVENTOR(S) : Kjersem et al

It is certified that error appears in the above-identified patent and that said Letters Patent is hereby corrected as shown below:

Column 2, line 42 change "while" to -whole-

Column 4, line 56 change "ar" to -are-

Column 5, line 19 after "length" insert -thereof, and-

Column 7, line 68 cancel "be"

Column 8, line 2 change "a" to -as-

Signed and Sealed this

Ninth Day of August, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,288,174

DATED : February 22, 1994

INVENTOR(S) : Kjersem, et al

It is certified that error appears in the above-indentified patent and that said Letters Patent is hereby corrected as shown below:

Column 5, line 20 after "outer" insert --pipe and a--

Signed and Sealed this

Twenty-ninth Day of November, 1994

*Attest:*

Bruce Lehman

BRUCE LEHMAN

*Attesting Officer*

*Commissioner of Patents and Trademarks*